United States Patent [19]

Rose et al.

[11] Patent Number: 4,996,859

[45] Date of Patent: Mar. 5, 1991

[54] METHOD AND APPARATUS FOR ROLL FORMING METAL

[75] Inventors: A. Jay Rose, Independence; Michael A. Hamulak, Brooklyn, both of Ohio

[73] Assignee: A. J. Rose Manufacturing Company, Cleveland, Ohio

[21] Appl. No.: 425,804

[22] Filed: Oct. 23, 1989

[51] Int. Cl.[5] ..... B21D 22/18

[52] U.S. Cl. ..... 72/86

[58] Field of Search ..... 72/73, 74, 80, 82, 83, 72/84, 86, 87

[56] References Cited

U.S. PATENT DOCUMENTS

| | | | |
|---|---|---|---|
| 54,621 | 5/1866 | Spaulding | 72/82 |
| 70,281 | 10/1867 | Spaulding | 72/84 |
| 1,108,260 | 8/1912 | Slick | 72/84 |
| 1,115,786 | 11/1914 | Cromwell | 72/86 |
| 1,306,262 | 6/1919 | Knowles . | |
| 1,395,357 | 11/1921 | Putnam . | |
| 1,767,796 | 6/1930 | Hughes . | |
| 1,817,035 | 8/1931 | Hughes . | |
| 1,833,097 | 11/1931 | Taylor | 72/86 |
| 1,850,395 | 3/1932 | Hughes . | |
| 2,161,419 | 6/1939 | Kipperman et al. | 72/259 |
| 3,461,701 | 8/1969 | Marcovitch . | |
| 3,533,259 | 10/1970 | Marcovitch | 72/86 |
| 3,572,075 | 3/1971 | Sporck . | |
| 3,611,771 | 10/1971 | Ulrych . | |

FOREIGN PATENT DOCUMENTS

| | | | |
|---|---|---|---|
| 102243 | 6/1985 | Japan | 72/267 |
| 1227300 | 4/1986 | U.S.S.R. | 72/84 |
| 1328043 | 8/1987 | U.S.S.R. | 72/82 |

*Primary Examiner*—Robert L. Spruill

*Attorney, Agent, or Firm*—Pearne, Gordon, McCoy & Granger

[57] ABSTRACT

A method and apparatus for producing a disc structure. The disc provides a radially extending annular wall formed by pressing a workpiece against a contoured tool with a pressure roll. The contoured tool and workpiece move relative to the pressure roll about a first axis while the tool and pressure roll move toward each other in the direction of the first axis. The pressure roll rotates about a second axis perpendicularly intersecting the first axis and provides a cylindrical working surface. The tooling is arranged to radially confine the workpiece. In one embodiment, the tool is formed with a plurality of ribs extending in the direction of the first axis. These ribs cooperate to produce annular grooves in the workpiece along the surface thereof remote from the pressure roll. One embodiment provides a disc particularly suited for use in electromagnetic clutches. The other embodiment may be used to produce wheels, pulleys, and the like.

21 Claims, 5 Drawing Sheets

METHOD AND APPARATUS FOR ROLL FORMING METAL

BACKGROUND OF THE INVENTION

This invention relates generally to the forming of metal, and more particularly to a novel and improved method and apparatus for roll-forming metal parts and to novel and improved articles formed by such method.

PRIOR ART

The shaping of metal by applying forces to cause the plastic deformation of the metal is generally known as forming or forging. The pressure required to produce plastic deformation is determined by the properties of the workpiece at the temperature at which the working is performed.

When forming workpieces having relatively large areas that must be deformed, it is common to heat the workpiece to improve the deformability thereof. Hot-forming is also employed in many instances in which substantial changes in cross section are required. Hot-forming, however, is generally undesirable in that it requires elaborate equipment to heat the workpieces. Further, tool wear and breakage are increased when the tools are exposed to elevated temperatures. Still further, scale tends to develop on heated workpieces, and such scale tends to cause rapid tool deterioration.

In order to reduce the force required to produce a given part, it is also known to use a rotary system in which the workpiece is engaged with the forming pressure along a relatively small area which progressively moves over the surface of the workpiece. Since the area of contact is small, the pressure required to produce plastic deformation is achieved with smaller total forces. Examples of such forming processes are manual and power spinning and disc rolling. Examples of disc rolling are illustrated by U.S. Pat. Nos. 1,306,262; 1,395,357; 1,767,796; 1,817,035; 1,850,395; 3,461,701; 3,572,075; and 3,611,771.

Generally, in spinning, the deforming forces are inclined toward the axis of the workpiece rotation and involve the forming of sheet material.

In the disc rolling processes of the above cited patents, the workpiece is positioned between the working faces of two tools which are conical or approach conical surfaces. The tools are rotated together about two intersecting inclined axes so that the tools deform only a portion of the workpiece at any given time. Therefore, lower forces are required to cause the required plastic flow of the workpiece.

Because the process involves the forming of workpieces between surfaces which are essentially conical, a rolling contact tends to occur and slippage between the tool and the workpiece is minimized. However, such working surfaces still provide substantial surface contact, particularly along zones substantially spaced from the axis of rotation of the workpiece. Consequently, such processes are normally performed hot to further decrease the required working forces.

SUMMARY OF THE INVENTION

The present invention provides a novel and improved method and apparatus for cold-forming relatively large workpieces with relatively small working forces. With this invention, it is possible to produce parts having complex shapes and substantial changes in cross section.

In the illustrated embodiments, the method involves positioning one face of a workpiece against a tool rotating about a first axis and having a working surface extending generally perpendicular to such axis. The opposite face of the workpiece is engaged by a roller tool rotating about a second axis perpendicularly intersecting the first axis. As the tools are rotated relative to each other about the first axis, they are moved toward each other along the first axis and apply the forming forces to the workpiece.

Because the roller engages only a small portion of the workpiece at any given time, regardless of the spacing of a particular zone from the axis of rotation, a relatively small working force is capable of producing plastic deformation of the workpiece even when the workpiece is unheated. In effect, the contact between the workpiece and the roller is substantially line contact having a very small area, so high pressures are achieved with relatively low working forces.

In a first illustrated embodiment, a radial surface of a workpiece is deformed to produce a plurality of arcuate grooves interrupted by radially extending, peripherally spaced bridges. Such workpiece is used to provide a disc in an electromagnetic clutch. The disc is formed of magnetic material and the material of the ribs between the grooves forms magnetic poles. The bridges mechanically connect the ribs to provide the workpiece with mechanical strength.

Prior discs of a similar type usually required punched out banana slots or laser cut banana slots. In most instances, the punched out slots required relatively large slot areas to provide the punch with sufficient strength. Laser cutting of the slots required extremely high powered laser equipment and required substantial time and energy to produce the desired banana slot. The electrical functioning of the disc in a clutch environment is not part of the present invention. However, reference may be made to U.S. Pat. No. 4,187,939 to provide a description of such a clutch system and to U.S. Pat. No. 4,685,202 concerning methods of laser cutting such discs.

In accordance with the method of the first embodiment, the material of the workpiece being deformed is sufficiently fully confined by the tools so that the direction of flow of the workpiece material is completely controlled. In effect, the tooling cooperates to function as a closed die even though most of the surface of the workpiece which is being deformed is unconfined. As mentioned previously, the working forces are applied along a line or narrow zone of contact and the material along such line is confined so the material can be displaced without any substantial radial flow into a cavity formed in the first tool having a complex shape. Since relatively low forces are required, tool breakage is minimized. Further, the mechanical properties of the workpiece are substantially improved by the cold working thereof.

In a second illustrated embodiment, parts are roll-formed to produce a disc-shaped product that can be used to form a pulley, a wheel, or other similar circular products. In this instance, a relatively small diameter workpiece is roll-formed between a tool and pressure roll to substantially increase its diameter by reducing its thickness. After forming, the workpiece provides a central hub, a thinned, radially extending web, and a lateral flange portion at the periphery of the web. Here again, the workpiece is positioned between a tool and a pressure roll which produces localized deformation of the material of the workpiece. The tool and pressure roll are again mounted for relative rotation about a first axis and are movable toward each other along such first axis. Again, the pressure roll is journaled for rotation about a second axis perpendicularly intersecting the first axis. In this instance, however, a third roller journaled for rotation about a third axis parallel to the first axis is provided to laterally confine the material of the workpiece and cause such material to deform into a rim or flange at the periphery of the web.

With this embodiment, it is possible to form pulleys, wheels and the like with an integral hub, web and peripheral rim.

These and other aspects of this invention are illustrated in the accompanying drawings, and are more fully described in the following specification.

DETAILED DESCRIPTION OF THE DRAWINGS

Figure 1:
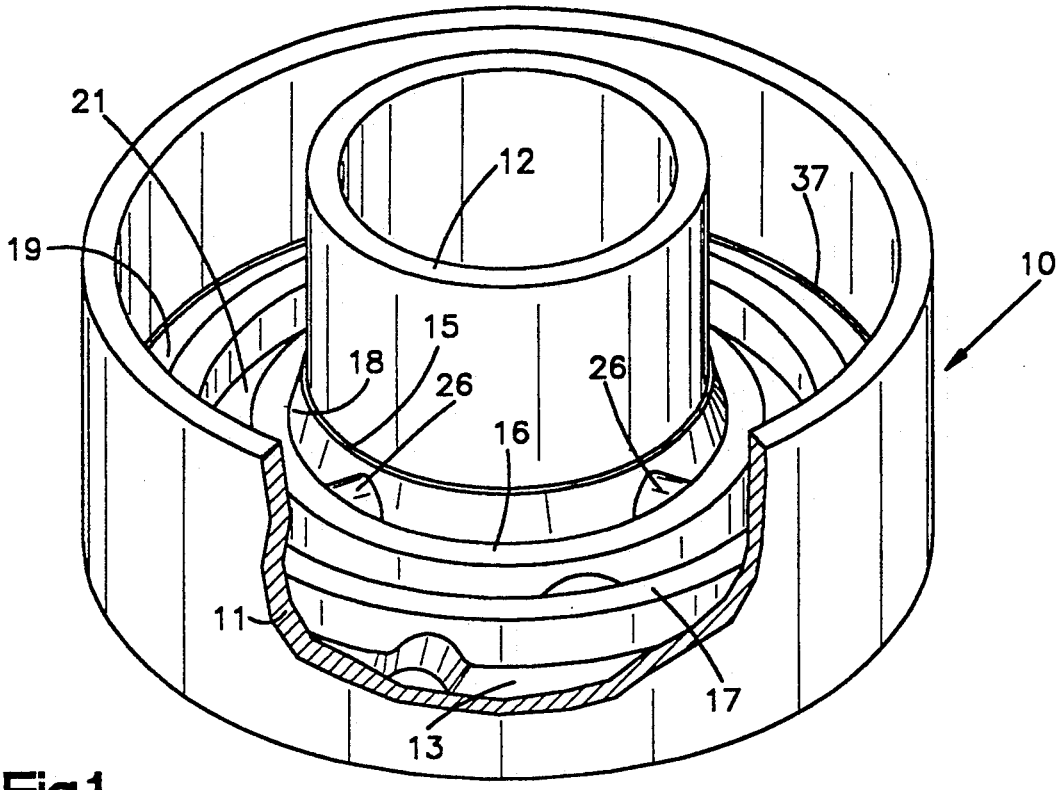
FIG. 1 is a perspective view of a clutch disc formed in accordance with the present invention, with portions broken away to better illustrate the structure thereof.

FIGS. 1 through 3*c* illustrate a novel and improved clutch disc 10 for an electric clutch produced in accordance with the method and apparatus incorporated in the present invention. The clutch disc 10 provides an outer cylindrical skirt 11 and an inner cylindrical hub 12 joined at one of their ends by a contoured radial wall 13. In the illustrated embodiment, the contoured wall 13 provides two axially extending concentric ribs 16 and 17. The rib 16 is separated from the inner hub 12 by a groove 18. The outer rib 17 is separated from the outer cylindrical skirt by a groove 19. A central groove 21 separates the two ribs 16 and 17. The grooves 18, 19, and 21 extend axially to blind ends 22 which are spaced from the outer surface 23 of the contoured radial wall 13. Therefore, the ribs 16 and 17 are joined together and join with the skirt 11 and hub 12. However, the distance between the blind ends 22 and the outer surface 23 is small so radial bridges are provided to interconnect the various ridges and cylindrical portions.

Figure 3B:
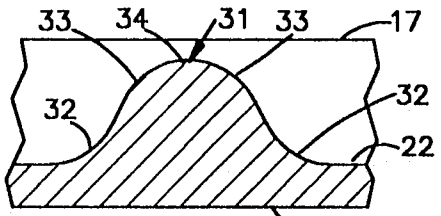
FIG. 3*b* is a greatly enlarged, fragmentary section taken along line 3*b*—3*b* of FIG. 3.
Figure 3A:
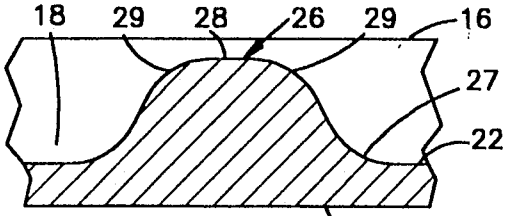
FIG. 3*a* is a greatly enlarged, fragmentary section taken along line 3*a*—3*a* of FIG. 3.
Figure 3:
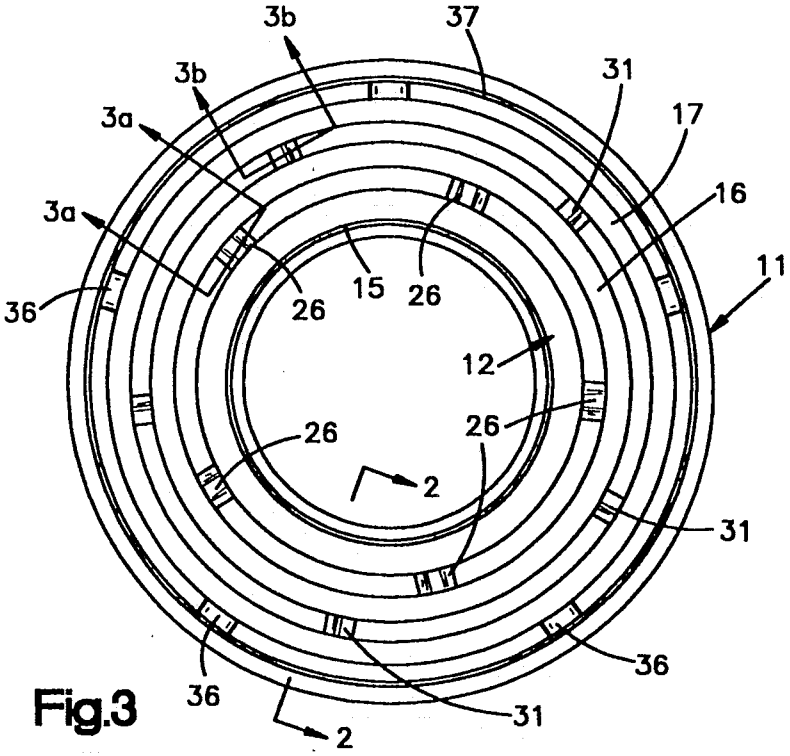
FIG. 3 is a plan view of the disc of FIGS. 1 and 2.

In the illustrated embodiment, five peripherally spaced and symmetrically located inner bridges 26 extend between the hub 12 and the inner rib 16. These bridges 26 have a height slightly less than the height of the associated inner rib 16 and have a cross section, best illustrated in FIG. 3*a*. The cross section illustrated in FIG. 3*a* illustrates the cross section of all of the bridges 26.

Each of the bridges 26 provides concave and convex radiused portions 27 and 29 joining the blind inner end 22 of the groove 18 and an upper extremity 28. The upper extremity 28, however, is slightly below the top of the rib 16, as illustrated in FIG. 3*a*. The radiused portions at 29 eliminate sharp corners, which are difficult to fill with plastic flow and which tend to produce stress concentrations and breakage in the die. Further, since the upper extremities of the bridges are below the upper extremities of the adjacent rib, full filling of the bridge forming the cavity is assured. The bridges 26 are sized and positioned so that a sufficient mechanical interconnection is provided between the hub 12 and the inner rib 16 to absorb the various loading conditions even when all or part of the material between the blind ends 22 and the outer surface 23 are machined away in subsequent finishing operations. Preferably, the inner hub 12 is formed with a narrow shelf 15 adjacent to one side of the groove 18. The bridges 26 extend from the shelf 15 and are integrally connected therewith at their inner ends. It has been found that such structure improves the strength of the joint or connection of the inner ends of the bridges to the hub 12.

A similar series of bridges 31 are provided between the inner rib 16 and the outer rib 17. In the illustrated embodiment, there are again five radially extending, peripherally spaced and symmetrically located bridges 31 formed between the two ribs 16 and 17. Here again, each of the bridges 31 is formed with a similar contour or cross section, which is best illustrated in FIG. 3*b*. Further, the bridges 31 are again smoothly curved, providing concave radiused portions 32 and convex radiused portions 33 blending with the upper extremity 34.

The bridges 31 are not quite as wide as the bridges 26, but have an upper extremity which, again, is slightly below the tops of the ribs 16 and 17 which are joined by the bridges 31. Here again, the bridges are shaped and sized so that they provide sufficient mechanical connection to support and interconnect the component parts of the disc even when some of the material between the blind end 22 of the groove 21 is machined away. Further, the bridges 31 are located offset from the bridges 26 so that the plastic flow of the disc material into one set of bridges does not hinder the plastic flow forming the other set of bridges. Since the crests of the bridges 26 are fully and accurately filled, they may be used as reference surfaces for subsequent machining operations.

Another set of peripherally spaced, radially extending, symmetrically located bridges 36 are formed to connect across the groove 19 between the rib 17 and the outer cylindrical skirt 11. Here again, five bridges 36 are provided each having a shape best illustrated in FIG. 3*b*. The outer cylindrical skirt 11 is formed with a narrow shelf 37 to which the outer ends of the bridges 36 are joined.

Figure 2:
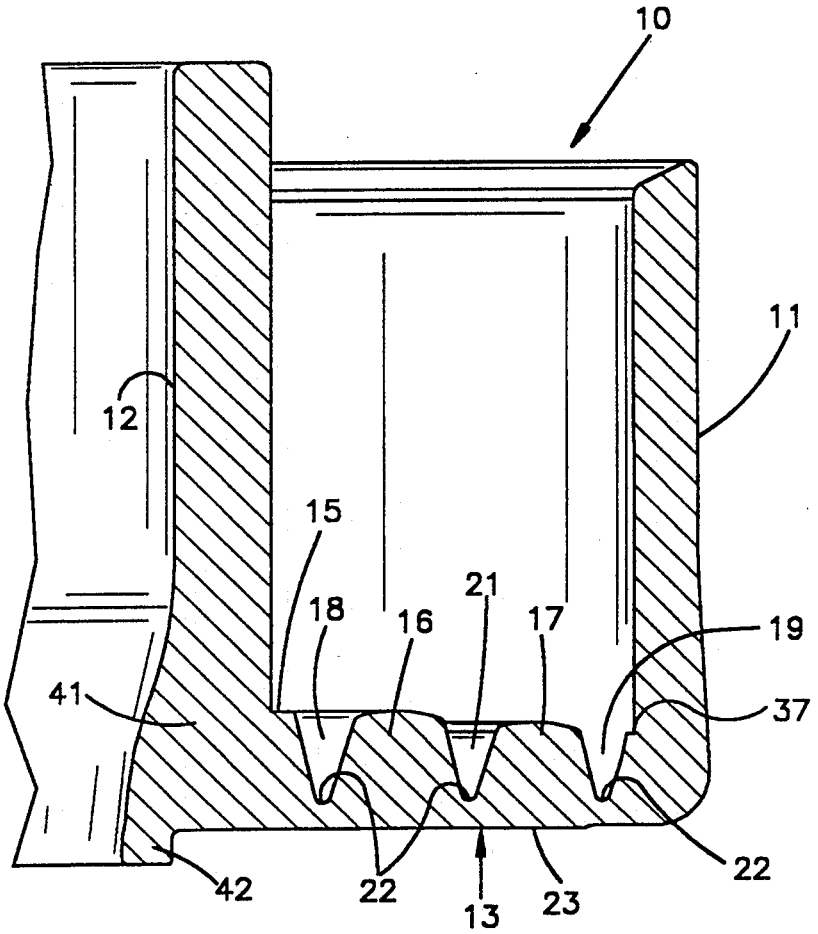
FIG. 2 is a fragmentary, radial section of the disc illustrated in FIG. 1.

In the illustrated embodiment, the portion of the inner cylindrical hub is thickened at 41 adjacent to the contoured radial wall 13 and provides an axially extending step 42 which may be used as a slinger to prevent grease or oil from reaching the outer radial surface. As best illustrated in FIG. 2, each of the grooves 18, 19, and 21 is generally V-shaped in lateral section having an open end width which is substantially greater than the width of the blind ends 22.

Figure 4:
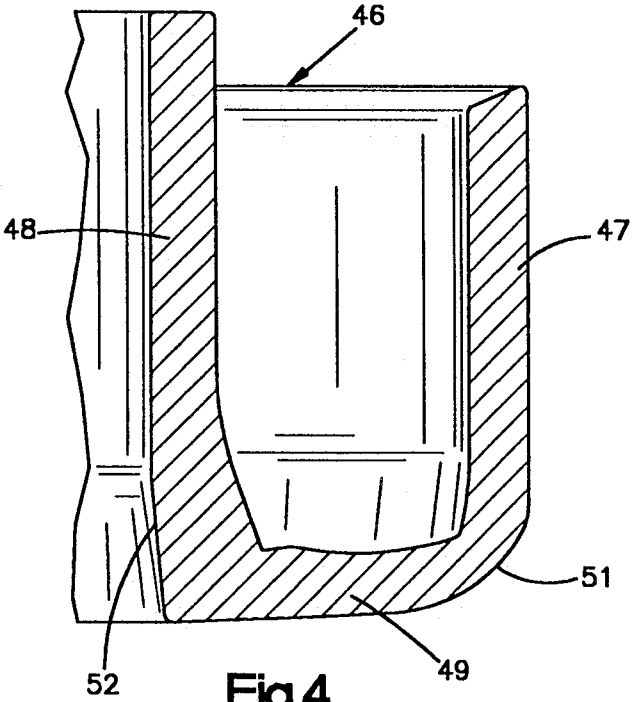
FIG. 4 is a fragmentary section similar to the section of FIG. 2, illustrating the workpiece prior to being roll-formed to the shape of FIGS. 1 through 3.

In accordance with the present invention, the contoured radial wall 13 is roll-formed between a tool and a roller from a workpiece or blank having a cross section illustrated in FIG. 4. This blank 46 includes an outer cylindrical skirt 47, an inner cylindrical hub 48, and a radial end wall 49 joining the adjacent ends of the skirt 47 and hub 48. Prior to the forming operation to produce the ribs, grooves, and bridges in the end wall 49, the end wall is formed with a relatively uniform thickness. A comparison of the cross sections of FIGS. 2 and 4 will illustrate the manner in which the material flows during the forming operation discussed below. For example, the outer surface 51 at the junction between the cylindrical skirt and the end wall 49 is formed with a relatively large radius of curvature prior to the forming operations but is more sharply defined after the forming operation. Also in the blank 46, the projection 42 does not exist.

Figure 5:
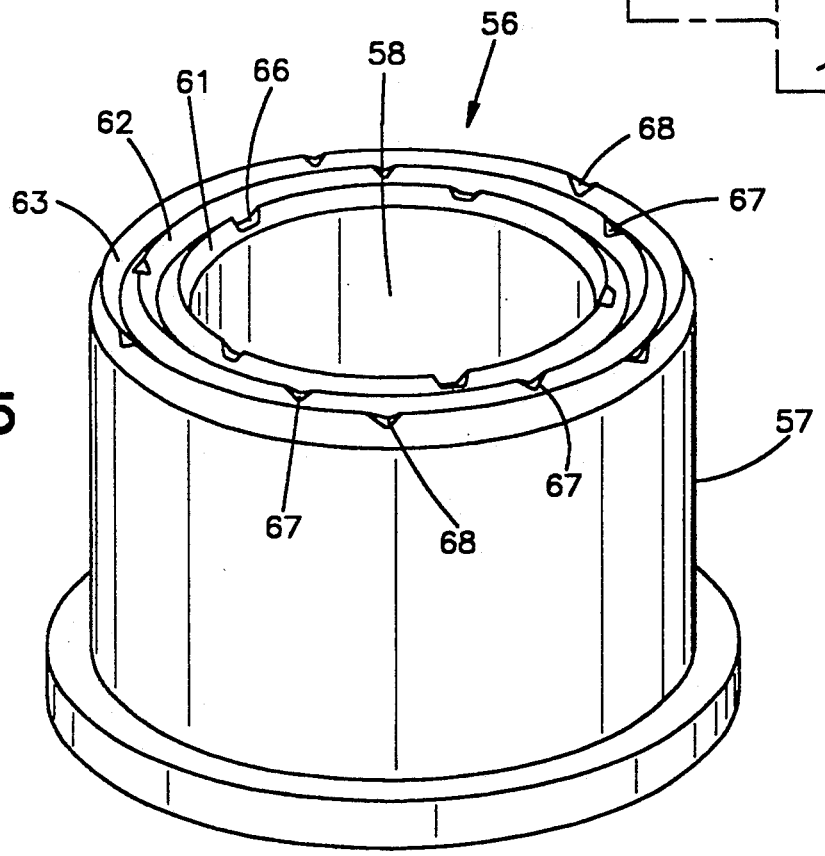
FIG. 5 is a perspective view of the tool used to form the disc of FIGS. 1 through 3.

The blank of FIG. 4 is roll-formed to the shape of the disc of FIGS. 1 through 3*b* in the following manner. A tool 56 illustrated in FIG. 5 is positioned within the cavity between the skirt 47 and hub 48 of the blank 46. This tool is tubular, providing an outer cylindrical surface 57 and an inner cylindrical surface 58 shaped to mate respectively with the inner surface of the cylindrical skirt 11 and the outer surface of the hub 12 of the disc 10. The end of the tool is formed with three annular ribs 61, 62, and 63 extending axially of the end face. These ribs are shaped and spaced so as to create the grooves 18, 19, and 21. The rib 61 creates the groove 18, the rib 62 creates the groove 21, and the rib 63 creates the groove 19. Formed in the ribs 61, 62, and 63 are bridge forming recesses 66, 67, and 68, which respectively form the bridges 26, 31, and 36. These recesses have smoothly blended edges which produce the smoothly curved contour of the associated bridges. It is important to eliminate sharp corners in the tool, since such corners tend to fracture and cause tool failure, whereas, smoothly curved and blended shapes are not as susceptible to fracture failures.

Figure 6:
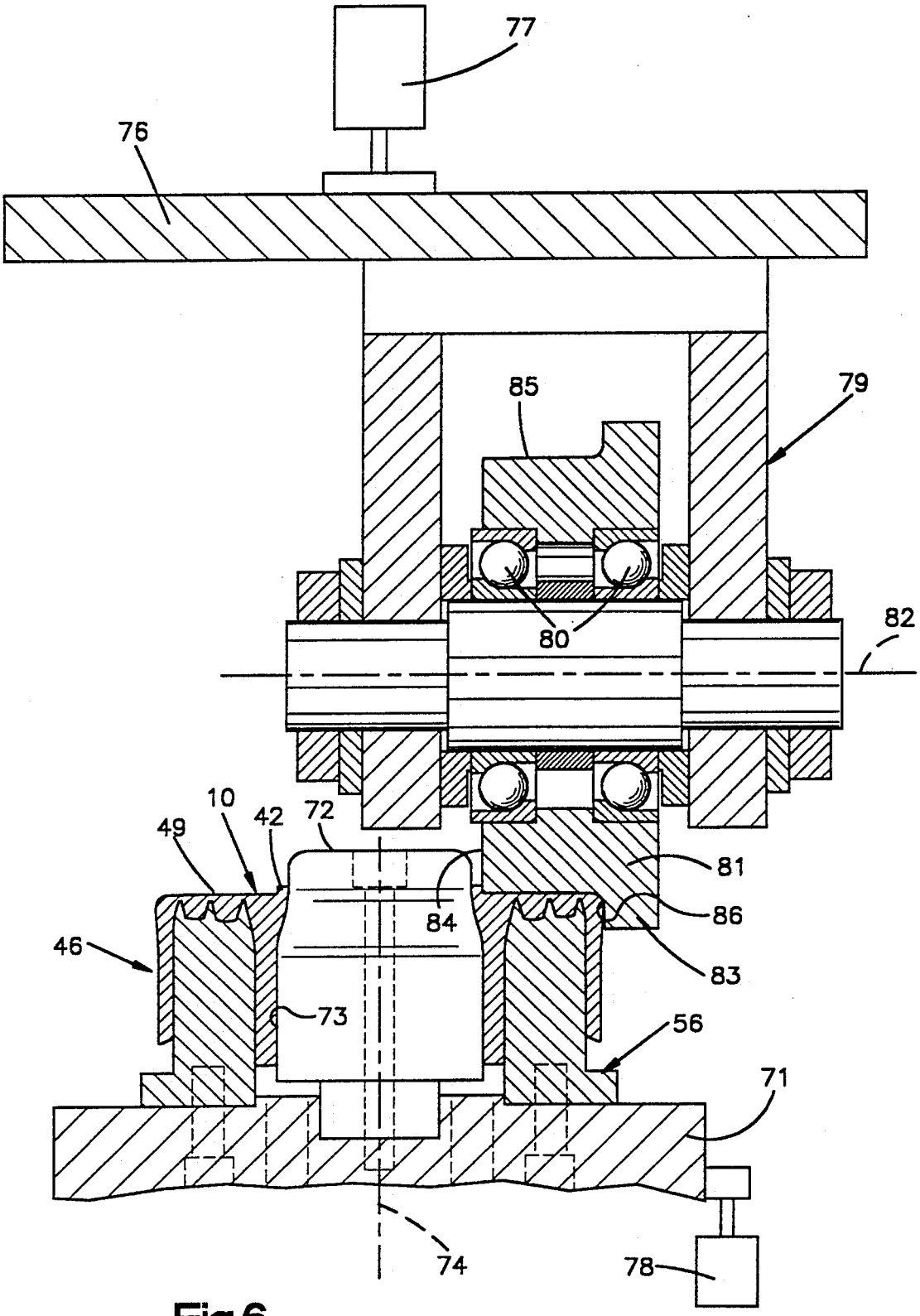
FIG. 6 is a fragmentary, schematic vertical section of the apparatus for producing the disc of FIGS. 1 through 3.

The roll-forming with the tool 56 is performed in a machine schematically illustrated in FIG. 6. The machine provides a base or frame 71 on which the tool 56 is mounted. Concentric with the tool 56 is a center mandrel 72, also mounted on the base 71. The outer surface 73 of the mandrel 72 is contoured to exactly mate with the interior surface of the clutch disc 10 and cooperate with the tool 56 to define a cylindrical cavity which receives the hub 48. The surfaces of the tool 56 and the mandrel 72 are concentric around the center axis 74. The base 71 on which the tool 56 and mandrel 72 are mounted is journaled for rotation about a center axis 74. A drive motor schematically illustrated at 78 is connected to rotate the base 71, tool and mandrel about the axis 74.

Mounted above the base 71 is a ram 76 which is mounted for vertical movement along the axis 74 and is powered for such movement by an actuator 77. A roller support assembly 79 is mounted on a ram 76 for vertical movement therewith. Journaled on the support 79 by bearings 80 is a roller 81 rotatable relative to the support about an axis 82. The axis 82 perpendicularly intersects the axis 74. If desired, two identical, opposite rollers 81 may be provided to provide a symmetrical system and symmetrical loads.

The roller 81 is provided with a cylindrical, peripheral working surface 85 which is laterally offset from the axis 74 and positioned to engage the end wall 49 of a blank 46 supported on the tool 56. This is the working surface which presses the blank progressively down against the end face of the tool 56 to form the ribs, grooves, and bridges. The roller is also provided with a radially extending flange 83 positioned to engage the outer surface of the cylindrical skirt 47 of the blank to confine the material of the blank in a radial direction. In the illustrated embodiment, the inner edge 84 of the roller 81 is spaced a small distance from the adjacent wall of the mandrel 72 to permit the formation of the projection 42.

The deformation of the blank 46 illustrated in FIG. 4 to the clutch disc 10 illustrated in FIGS. 1 through 3*c* is accomplished by rotating the tool 56 about its center axis 74 while the roller 81 is progressively moved downwardly against the end wall 49 of the blank 46. This produces relative movement between the workpiece and the roller, in which the roller rolls around the workpiece and moves along the axis 74 to press the material of the workpiece into the grooves formed in the tool 56.

This is a progressive operation in which only a small portion of the workpiece is subjected to deforming forces at any given time. Since only a small portion of the workpiece is subjected to deforming forces at any given time, relatively low working forces are required. For example, satisfactory flow of the material of the workpiece occurs when a force of no greater than 20 tons is applied by the actuator 77, even though proper flow into the convolutions of the tool could not be achieved in a typical press capable of exerting 250 tons of force. Further, since the force is applied in small localized areas at any given time in the deformation operation, the overall loading on the tool is not excessive and tool life is satisfactory.

By providing the roll 81 with a flange 83, which radially confines the material of the workpiece during the deformation process, a system is provided in which the material being worked is, in effect, fully confined except in those zones where flow of the workpiece material is desired, for example, initially, radial flow occurs to fill the radiused corner at 86 between the cylindrical working surface 85 and the flange 83. Similarly, as the working progresses, the thickness of the inner hub adjacent to the contoured radial wall 13 increases. Further, the material flows down into the grooves formed in the tool to form the ribs 16 and 17 and the grooves 18, 19, and 21. Since the extremities 28, 34, and 37 of the bridges are located below the tops of the adjacent ribs, the bridges are fully formed.

Figure 7:
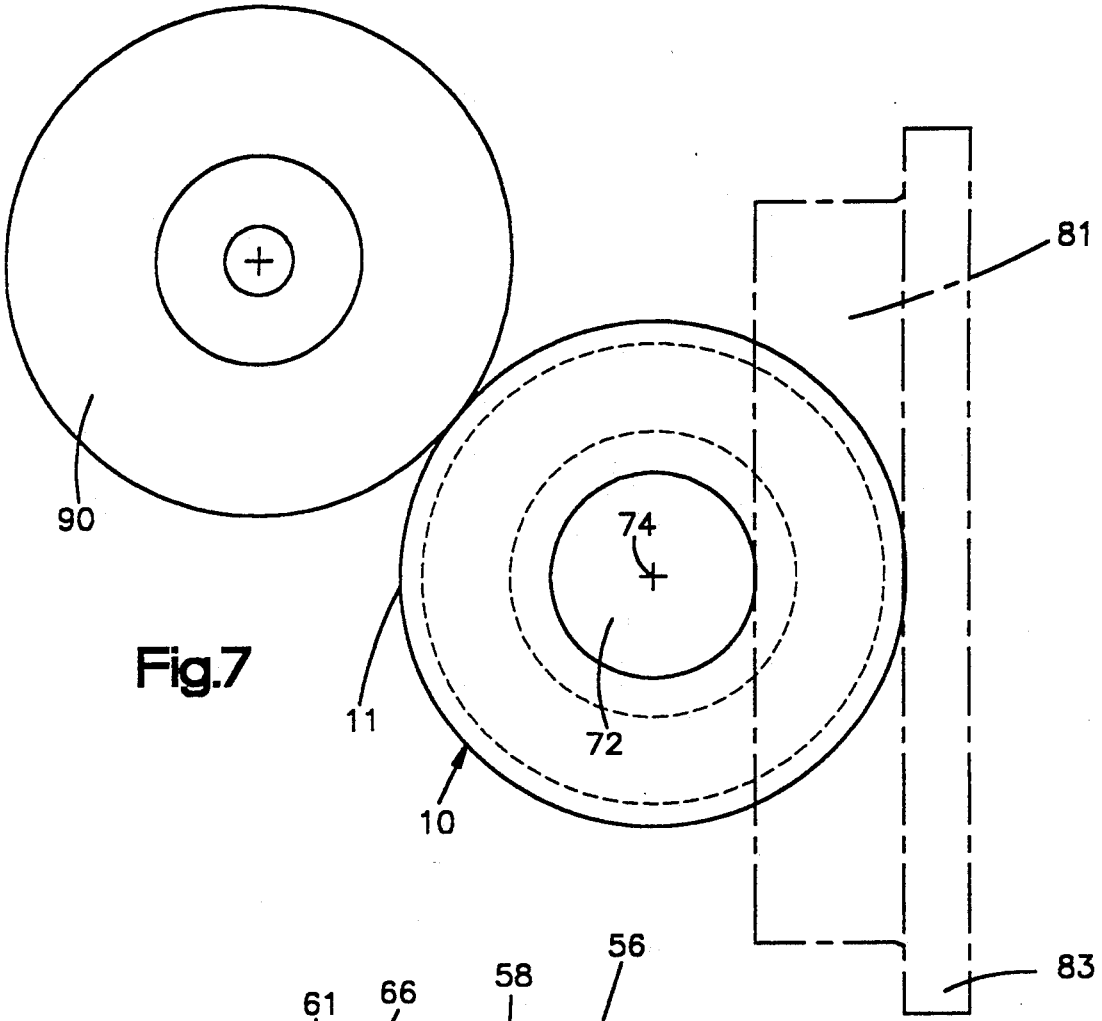
FIG. 7 is a fragmentary, schematic plan view of the machine illustrated in FIG. 6.

In the preferred apparatus, a roller 90 (illustrated in FIG. 7) is journaled for rotation about an axis parallel to the axis 74 and engages the outer surface of the cylindrical skirt 11. The roller 90 cooperates with the flange 83 to radially confine the flow of material of the disc.

In order to provide a finished workpiece which does not have any weakening folds and the like, the tool 56, in cooperation with the roller 81, is structured so that the flow of material during the deformation process does not encounter directional reversals which would produce folds of weakness within the finished product.

It is also important to arrange the feed rate of the roller in the direction of the axis 74 so that the workpiece does not turn relative to the tool. If the workpiece were to turn relative to the tool, it would be impossible to form the bridges which have radially extending surfaces. It has been found, for example, that when the diameter of the roller is about six inches and the feed is about 0.008 inch per revolution, the workpiece does not turn relative to the tool during the deforming process and a properly formed, contoured radial wall 13 is produced. On the other hand, if the feed rate is excessive, relative rotation occurs between the workpiece and the tool, preventing proper formation of the part.

Because the working surface 85 of the roller 81 is cylindrical, a substantial amount of sliding action occurs between the surface 85 and the engaged surface of the workpiece. For example, the portions of the roller adjacent to the inner edge 42 tend to slide in a forward direction, whereas, the portions of the surface 85 adjacent to the flange 83 tend to slide in a backward direction. This sliding movement produces a desirable result, since the outer surface of the workpiece tends to be burnished to a very smooth finish.

The disc of the embodiment of FIGS. 1 through 7 is particularly suited for use as a multiple pole coupling disc for electromagnetic couplings. The disc is made of magnetic material. The outer surface 23 provides a working face which is adapted to engage another coupling disc of an electromagnetic coupling. The grooves delineate adjacent magnetic poles and are spaced back from the surface 23 to leave the working face free of interruptions. The grooves include radially spaced rows of angularly spaced grooves so that bridges made of magnetic material are provided having a thickness which is approximately equal to the thickness of the disc.

Figure 8:
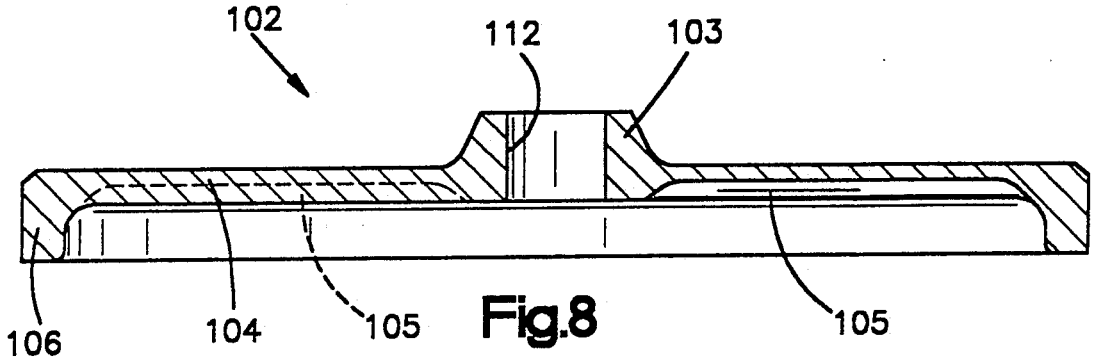
FIG. 8 is a longitudinal section of a pulley or wheel in accordance with the second embodiment of this invention.
Figure 9:
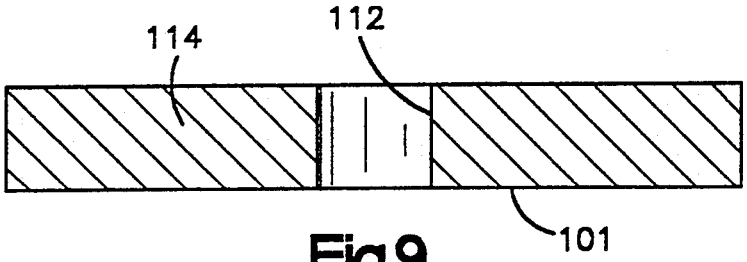
FIG. 9 is a cross section illustrating the workpiece prior to being formed to the pulley or wheel of FIG. 8.
Figure 10:
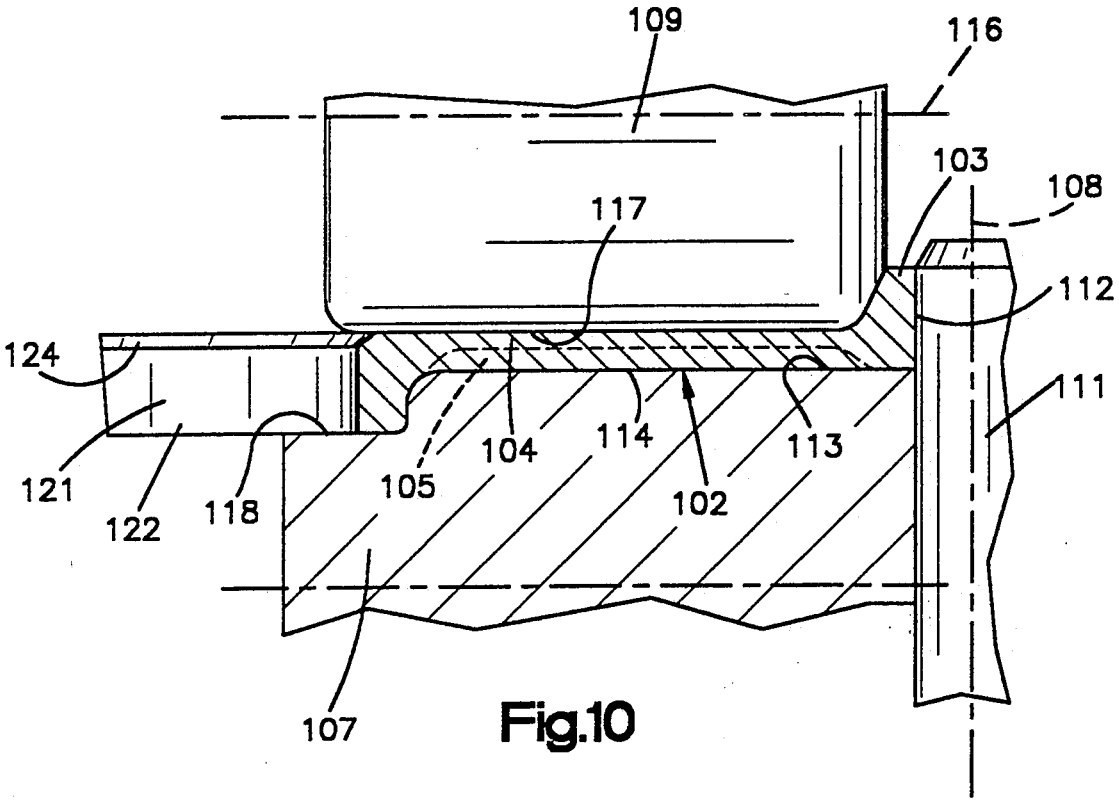
FIG. 10 is a schematic illustration of the tooling used to form the pulley of FIG. 8 from the workpiece of FIG. 9.

FIGS. 8 through 10 illustrate a second embodiment of this invention in which a workpiece 101, illustrated in FIG. 9, is roll-formed to produce a wheel or pulley-like article 102. The article 102 provides an integral hub 103, a relatively thin web 104 with radially extending ribs or spokes 105, and a laterally extending rim 106. Such article can be, for example, subsequently formed into a pulley or a finished wheel. With this structure, however, a fully homogeneous article is provided.

The apparatus for producing the article 102 is illustrated in FIG. 10, and includes a tool 107 mounted for rotation about a central axis 108 beneath a roller 109. A mandrel 111 extends up along the axis 108 through the tool 107 and closely fits a central bore 112 formed in the workpiece 101.

The tool 107 provides a radial working face 113 which engages one side 114 of the workpiece. The working face 113 is formed with radial grooves to form the spokes 105. The roller 109 is journaled for rotation about an axis 116 which perpendicularly intersects the axis 108. The roller 109 is provided with a cylindrical working surface 117 which is parallel to the radial surface 113 of the tool. As the tool 107 is rotated, the roller 109 is moved along in a direction parallel to the axis 108 against the upper surface of the blank, causing the metal to be radially deformed outwardly producing the web 104. The inner edge of the roller 109 is spaced from the mandrel 111 so that the hub 103 remains at essentially the original thickness of the workpiece.

In order to produce the rim 106, the tool 107 is provided with a peripheral recess 118 offset from the surface 113. This provides a lateral cavity at the outer extremity of the web 104, in which the rim is formed. A second roller 121 is journaled for rotation about an axis parallel to the axis 108 and is provided with a peripheral surface which cooperates with the offset 118 in the reduced diameter portion 119 to form a cavity in which the rim 106 is formed. Preferably, the periphery of the roller is provided with a cylindrical portion 122 and a wedge-shaped rib 124 which engages the material of the blank as it flows into the outer cavity and deflects the material downwardly to produce the illustrated rim.

Again with this embodiment, substantial working can be achieved at relatively low forces, since only a small portion of the material is subjected to deforming forces at any given time. Further, in this embodiment, like the first embodiment, the tool and the rollers cooperate to provide a substantially closed die cavity in the zone where the working is actually occurring so that the flow of the material is directed in the desired manner and a finished part can be accurately produced.

Although the preferred embodiments of this invention have been shown and described, it should be understood that various modifications and rearrangements of the parts may be resorted to without departing from the scope of the invention as disclosed and claimed herein.

What is claimed is:

1. A roll-forming machine comprising a frame, a tool and pressure roll mounted on said frame, said pressure roll and tool being rotatable relative to each other around a first axis and movable toward each other along said first axis, said pressure roll being journaled on said frame for rotation about a second axis perpendicularly intersecting said first axis, said tool providing an annular first working face around said first axis extending generally radially with respect thereto, said pressure roll providing an annular second working face around said second axis, said second working face of said pressure roll and said first working face of said tool cooperating to progressively deform a workpiece as said pressure roll and tool rotate relative to each other and move toward each other, said first working face of said tool providing an axially extending ridge around said first axis cooperating with said second working face of said pressure roll to form an annular groove on said workpiece, said ridge being interrupted at peripherally spaced locations to provide recesses to produce peripherally spaced ridges in said groove extending radially across said groove on said workpiece.

2. A roll-forming machine as set forth in claim 1, wherein said recesses are smoothly curved and have a depth less than the height of said ridge.

3. A roll-forming machine as set forth in claim 2, wherein said tool is structured to form a shelf adjacent the ends of at least some of said bridges.

4. A roll-forming machine as set forth in claim 1, wherein said working face of said tool provides a plurality of concentric axially extending ridges cooperating with said working surface of said pressure roll to form a plurality of concentric annular grooves in said workpiece.

5. A roll-forming machine as set forth in claim 1, wherein said machine provides power means for producing relative rotation between said tool and pressure roll and axial feeding of said tool and pressure roll toward each other without rotationally driving said pressure roll, said power means operating to feed said tool and pressure roll toward each other a predetermined distance for each relative rotation of said tool and pressure roll, said predetermined distance being sufficiently small to cause said workpiece to remain fixed against rotation relative to said tool without locking said workpiece against rotation relative to said tool.

6. A roll-forming machine as set forth in claim 5, wherein said pressure roll is contoured to limit radial flow of said workpiece material and to cause material flow into the zones between said ridges.

7. A roll-forming machine for plastically deforming the material of a workpiece comprising a frame, a tool and pressure roll mounted on said frame, said pressure roll and tool being rotatable relative to each other about a first axis, said pressure roll being journaled for non-driven free rotation about a second axis extending generally normal to said first axis, said tool providing a first working face extending substantially radially around said first axis, said pressure roll providing a substantially cylindrical second working face concentric with said second axis, and power means causing relative rotation between said tool and pressure roll about said first axis and relative movement toward each other in the direction of said first axis, said working faces being operable to plastically deform said workpiece therebetween, said machine providing a second roll journaled for rotation about a third axis substantially parallel to said first axis, said second roll being operable to limit radial flow of said material of said workpiece.

8. A roll-forming machine as set forth in claim 7, wherein said first working face is contoured to produce a mating contour on said workpiece.

9. A roll-forming machine as set forth in claim 8, wherein said pressure roll provides an outer flange operable to limit radially outward flow of said material of said workpiece.

10. A roll-forming machine as set forth in claim 9, wherein said machine is operable to produce articles having a contoured radially extending wall.

11. A roll-forming machine as set forth in claim 10, wherein said pressure roll exerts plastic deforming pressure on said workpiece along a narrow zone of substantially uniform width extending generally radially with respect to said first axis.

12. A roll-forming machine as set forth in claim 9, wherein said machine is operable to produce articles having a hub, a thinned web, and a peripheral flange.

13. A method of roll-forming workpieces comprising providing a tool having a working surface extending substantially radially with respect to a first axis, providing said working surface with a contour to mate with the desired shape of an associated portion of said workpieces, providing a pressure roller journaled for non-driven free rotation about a second axis extending substantially normal to said first axis, and positioning said workpiece between said tool and pressure roll and while producing relative rotation between said tool and pressure roll about said first axis and producing relative motion of said roll and tool toward each other along said first axis causing said portion of said workpiece to be deformed therebetween, said pressure roll engaging said portion of said workpiece with a deforming force applied to said portion of said workpiece along a narrow zone, said narrow zone being applied progressively around said first axis until said portion is deformed to its required shape, substantial slippage existing between said pressure roll and said portion during said deformation and providing said pressure roll with a cylindrical working face so that said narrow zone is uniform in width.

14. A method as set forth in claim 13, including providing said pressure roller with a flange engaging said workpiece radially beyond said portion of said workpiece limiting radial flow of the material forming said workpiece.

15. A method as set forth in claim 13, including providing said working surface with an axially extending groove into which said workpiece flows to produce an axially extending rib on said workpiece.

16. A method as set forth in claim 15, including providing a plurality of concentric grooves in said working surface operating to produce a plurality of concentric ribs on said workpiece.

17. A method as set forth in claim 13, including providing a plurality of axially extending tool ribs and grooves in said working surface around said first axis, and pressing said tool ribs into said workpieces to form a plurality of workpiece grooves separated by workpiece ribs in said portion of said workpiece.

18. A method as set forth in claim 17, including forming said tool ribs with interruptions defining cavities, and deforming the material of said workpieces into said cavities to form bridges connecting said workpiece ribs.

19. A method as set forth in claim 18, including forming said cavities with a depth less than the depth of said tool groove.

20. A method as set forth in claim 18, including forming said cavities with smoothly curved surfaces.

21. A method of forming articles by the plastic deformation of the material thereof comprising supporting one surface of a portion of said article on a first working surface extending substantially radially around a first axis, and applying pressure to the opposite surface of said portion along a narrow zone of substantially uniform width while progressively moving said zone around said first axis to progressively cause plastic deformation of said material and thereby produce a desired shape, and radially confining said material of said articles along said zone to control the radial flow of said material, and plastically deforming said material of said articles to produce articles which are clutch discs having a plurality of concentric ribs joined by radially extending bridges.

* * * * *